US007396434B2

(12) United States Patent
Rodriguez Rivera et al.

(10) Patent No.: US 7,396,434 B2
(45) Date of Patent: Jul. 8, 2008

(54) CATALYTIC REACTOR PROCESS FOR THE PRODUCTION OF COMMERCIAL GRADE PULP, NATIVE LIGNIN AND UNICELLULAR PROTEIN

(76) Inventors: Jose Antonio Rodriguez Rivera, Carlos Sta Ma 604 OTE, Durango, Durango (MX) 34000; Kelly Anthony O'Flynn, 2360 Boucherie Rd., Kelowna, BC (CA) V1Z 2E6

( * ) Notice: Subject to any disclaimer, the term of this patent is extended or adjusted under 35 U.S.C. 154(b) by 11 days.

(21) Appl. No.: 10/859,227

(22) Filed: Jun. 3, 2004

(65) Prior Publication Data

US 2005/0269048 A1 Dec. 8, 2005

Related U.S. Application Data

(60) Provisional application No. 60/474,961, filed on Jun. 3, 2003.

(51) Int. Cl.

| | |
|---|---|
| ***D21C 3/16*** | (2006.01) |
| ***D21C 1/04*** | (2006.01) |
| ***D21C 3/02*** | (2006.01) |
| ***D21C 3/26*** | (2006.01) |
| ***D21C 9/02*** | (2006.01) |

(52) U.S. Cl. ..... 162/16; 162/29; 162/41; 162/52; 162/57; 162/70; 162/81; 162/90

(58) Field of Classification Search ..... 162/24, 162/9, 14, 16, 25, 26, 29, 41, 52, 57, 45, 162/70, 81, 86, 89, 90; 435/277, 278, 272
See application file for complete search history.

(56) References Cited

U.S. PATENT DOCUMENTS

| | | | | |
|---|---|---|---|---|
| 3,767,534 | A * | 10/1973 | Miura | 162/16 |
| 4,652,341 | A * | 3/1987 | Prior | 162/79 |
| 5,635,024 | A * | 6/1997 | Shall | 162/16 |
| 5,705,369 | A * | 1/1998 | Torget et al. | 435/105 |
| 5,730,837 | A * | 3/1998 | Black et al. | 162/77 |
| 2002/0069987 | A1 * | 6/2002 | Pye | 162/77 |
| 2003/0041982 | A1 * | 3/2003 | Prior | 162/24 |
| 2004/0060673 | A1 * | 4/2004 | Phillips et al. | 162/24 |
| 2004/0244925 | A1 * | 12/2004 | Tarasenko | 162/79 |

FOREIGN PATENT DOCUMENTS

| | | | |
|---|---|---|---|
| CA | 976702 | * | 10/1975 |
| MX | 165091 A | * | 2/1992 |

* cited by examiner

*Primary Examiner*—Eric Hug
(74) *Attorney, Agent, or Firm*—Paul Smith; Smiths IP

(57) ABSTRACT

A continuous and batch system to produce cellulose, native lignin and unicellular protein from any form of vegetation in a closed process. The biomass is mixed in the impregnate solution of nitric acid and/or ammonium hydroxide and water. After a period of time at room temperature and atmospheric pressure the chemical solution is recycled. The biomass is moved to the reactor and heated. Evaporated impregnate is recovered via absorption tower and recycled back to chemical solution. The biomass is moved to an alkaline solution, then cooled to separate pulp from black liquor. The black liquor is pumped to a separation tank and is treated to precipitate lignin. The solution is filtered to separate sweet liquor and lignin. The lignin is dried and the sweet liquor is fermented to produce unicellular protein.

5 Claims, 6 Drawing Sheets

Acid Catalyzed Hydrolysis - Mechanism

*Mechanism*

CATALYTIC REACTOR PROCESS FOR THE PRODUCTION OF COMMERCIAL GRADE PULP, NATIVE LIGNIN AND UNICELLULAR PROTEIN

CROSS REFERENCE TO RELATED APPLICATIONS

This application claims the benefit of U.S. Provisional Application No. 60/474,961, filed Jun. 3, 2003.

FIELD OF THE INVENTION

The invention relates to a process for treating lignocellulosic material, and in particular involves the acid catalyzed hydrolysis of impregnated wood chips to partially de-polymerize the lignin matrix with subsequent distillation, condensation and recovery of the acid catalyst.

BACKGROUND OF THE INVENTION

Prior art processes for treating lignocellulosic material often require high temperatures and pressures to ensure the chemical reactions proceed at a sufficient rate. As a result, special pressure vessels and specialized equipment is necessary to withstand the harsh conditions. This makes processing facilities very expensive to outfit and maintain, as well as being expensive to operate, with high energy demands.

In addition, strong chemicals are generally required to produce the desired oxidation or reduction reaction. The chemicals attack the equipment as well as the lignocellulosic material, again increasing maintenance costs for the facility. Once used, the chemicals must be disposed of, creating potential environmental hazards and pollution. Even water used during the treatment process can become contaminated and require careful handling to prevent pollution and environmental damage. Fresh chemicals must then be purchased to replace those lost during the treatment process.

Most processing facilities, despite the expensive, sophisticated equipment in place, can only be used to process a limited selection of plant material. Different plant materials require different processing conditions and chemicals, and occasionally different processing methods, meaning other plant materials cannot be processed without a complete re-tooling of the process line, if at all. It is preferable to be able to process many types of vegetation without the need to re-tool or change the facility equipment.

It is therefore an object of the invention to provide a process for treating lignocellulosic material which overcomes the above limitations and provides other desirable features.

This and other objects of the invention will be appreciated by reference to the summary of the invention and to the detailed description of the preferred embodiment that follow.

SUMMARY OF THE INVENTION

The invention is a continuous and batch system to produce cellulose, native lignin and unicellular protein from any form of vegetation in a closed process.

The hydrolytic Catalytic Reactor Process (CRP) produces commercial grade pulp and separates sweet liquor (sugars and hemi cellulose) from native form lignin—a natural lignin not altered by high temperatures or processing. The sweet liquor is further converted to a unicellular protein which can be converted to many different products. The process's waters and the catalytic chemicals are recycled.

The crux of the CRP process is the acid catalyzed hydrolysis of impregnated wood chips. The acid catalyst effects the partial de-polymerization of the lignin matrix in the chemical reactor with subsequent distillation, condensation and recovery of the acid catalyst and recovery of native-form lignin. Much of the prior art in the field uses reduction/oxidation chemical reaction mechanisms. This basic difference in reaction mechanism allows for significant advantages of the CRP process.

For example, the vegetation is impregnated in a solution of nitric acid and/or ammonium hydroxide and water. After a period of time at room temperature and atmospheric pressure the chemical solution is recycled. The biomass is then moved to a catalytic reactor and heated. Evaporated impregnate is recovered via an absorption tower and is recycled back to chemical solution. The biomass is moved to an alkaline solution before being cooled to separate pulp from black liquor. The pulp may be processed as desired to produce saleable products. Black liquor is pumped to separation tank and is treated to precipitate lignin. The solution is filtered to separate sweet liquor and lignin. The lignin is dried and the sweet liquor is fermented to produce unicellular protein.

The process can utilize any species of plant including hardwoods, softwoods, shrubs, grain species, grasses etc. The process can utilize sawdust as the sole starting material (something that cannot be done commercially or specifically stated in patents examined to date).

The quality and quantity of lignin produced dictates the reaction conditions throughout the process. A distinct advantage is the elimination of "dry" raw materials. Indeed, green starting material can be utilized and is even preferred for the acid catalyzed hydrolysis of the native lignin polymer depending on the quantity of pulp, lignin and sweet liquor required.

The CRP pulping process does not require added pressure at any stage nor temperature ranges anywhere near those of traditional Kraft pulping processes. Basically, all temperatures at various stages of the process are below 90° C. and no external pressure is added to the reaction system.

The CRP pulping process is a closed system where virtually all chemicals used are recovered for reuse. Water used in the pulping process is recovered in saleable by-products, filtered for reuse or vented as steam. The vented steam could be used in providing energy for the pulping process thereby eliminating even this small loss of water and a potential energy source. The recovery of catalytic chemicals eliminates the need for high chemical cost during each cycle of the pulping process.

A small amount of chemicals are needed to bring back to strength each recovered chemical before being re-introduced into the process. The recovery of chemicals does not require external energy expense to achieve this (unlike current recovery stages in Kraft mills).

By using this novel process the following benefits are achieved:

1. Wet starting materials can be used—it is not necessary to dry the chips as the water is essential to the hydrolysis.
2. Hydrolysis uses low temperatures, low pressures and little energy input.
3. Weak acids and bases are used, minimizing raw material costs and degradation of final products.
4. The acid catalysts are distilled and recycled allowing closed cycles.
5. The chemical reactor pulping process is essentially pollution free.
6. The chemical reactor pulping process gives a high yield of native Klason lignin.

7. The chemical reactor pulp yield of alpha cellulose is high.
8. The sweet liquor after precipitation is suitable for fermentation of unicellular protein.
9. The chemical reactor process is scalable with suitable mixer designs and when combined with the projected operating cost gives a return on construction investment of less than 2 years.
10. The chemical reactor process is highly efficient with costs half that of typical Kraft mills.

This results in the use of radically lower concentrations of acids and bases during the impregnation and digestion stages as well as significantly lower temperatures.

Since the CRP pulping process is a closed system with virtually zero discharge of chemicals or water into the environment, a mill utilizing this process will easily meet and exceed current environmental standards. Bearing this in mind, a pollutant-free-pulp mill could also garner tremendous profit potential under an EPA carbon dioxide pollution credit system.

The ability to process a wide variety of vegetation without any re-tooling gives flexibility in pulp production. Currently, mills are designed to produce specific pulp types and utilize specific wood species as raw materials. Furthermore, most mills require chips meeting stringent quality specifications. These limitations are avoided by the invention.

The economic viability of the CRP pulp process may be realized in the sale of pulp alone. Other benefits are potential EPA credits and the production of native lignin products and of unicellular protein for sale to others. It is noted that unicellular protein from a vegetative source would be free of any BSE pathogens and would be the preferred feed for cattle and other livestock animals presently raised for human consumption.

In one aspect, the invention is a method for producing pulp and lignin from lignocellulosic material, the pulp comprising cellulose, the method comprising contacting the lignocellulosic material with an aqueous acid solution to impregnate the lignocellulosic material, the aqueous acid solution comprising from about 10% to about 40% by weight of the acid; heating the lignocellulosic material in two stages, the first heating stage being carried out for a period of time which is sufficient to depolymerize lignin within the lignocellolosic material without substantially degrading the cellulose or lignin in the lignocellulosic material, the second heating stage being carried out at or above the boiling point of the acid to distill off the acid; contacting the lignocellulosic material with an aqueous alkaline solution under heat to solubilize lignin in the alkaline solution, leaving a black liquor; removing the pulp from the black liquor; adding sufficient acid to the black liquor to precipitate the lignin; and removing the lignin from the liquor.

In another aspect, the invention is a method for processing lignocellulosic material, comprising an impregnation step wherein the lignocellulosic material is soaked in an impregnate solution; a first recycling step wherein the impregnate solution is drained, filtered, strengthened and recycled to the impregnation step; a catalytic reaction step wherein the soaked lignocellulosic material is agitated in a catalytic reaction chamber and heated to a temperature above the vaporization point of the impregnate solution, thereby producing vaporized impregnate solution and lignin; a second recycling step wherein the vaporized impregnate solution is condensed and recycled to the saturation step; a digestion step wherein the lignin is agitated in a digester in the presence of black iron and an alkaline solution to produce pulp and a full strength black liquor; a processing step wherein the pulp is drained, washed and dried thereby producing dried pulp and dilute black liquor; a third recycling step wherein the dilute black liquor is recycled to the digestion step; a separation step wherein the full strength black liquor is cooled and agitated in the presence of an acid solution, thereby producing sweet liquor and precipitating natural form lignin; a filtration step wherein the sweet liquor is filtered to remove the natural form lignin; and a fermentation step wherein the sweet liquor is added to bacteria in a fermentation tank, thereby producing a unicellular protein as a fermentation product. The impregnate may be a nitric acid solution, or an ammonium hydroxide solution.

In another aspect, the invention is an apparatus for processing lignocellulosic material, the apparatus comprising an impregnation infeed to feed lignocellulosic material and impregnate solution into an impregnation tank, the impregnation tank comprising an impregnation ouffeed; a catalytic reaction chamber connected to the impregnation tank through the impregnation ouffeed, the catalytic reaction chamber comprising a first agitator and a catalytic ouffeed; a digester unit connected to the catalytic reaction chamber through the catalytic ouffeed, the digester unit comprising a second agitator mechanism and a digester ouffeed; a lignin separator connected to the digester unit through the digester ouffeed, the lignin separator comprising a third agitator mechanism and a separator ouffeed; and a fermentation tank connected to the lignin separator through the separator ouffeed.

In a further aspect, the impregnation tank may comprise a recycling ouffeed for recycling the impregnate solution and returning it to the impregnation tank. In yet a further aspect, the digester unit may comprise an impregnate condensation unit for recycling said impregnate solution and returning it to said impregnation tank In a further aspect, the invention is a unicellular protein produced using the above apparatus or the above method. In yet a further aspect, the invention is a natural form lignin produced using the above apparatus or the above method.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE PREFERRED EMBODIMENT OF THE INVENTION

Figure 1:
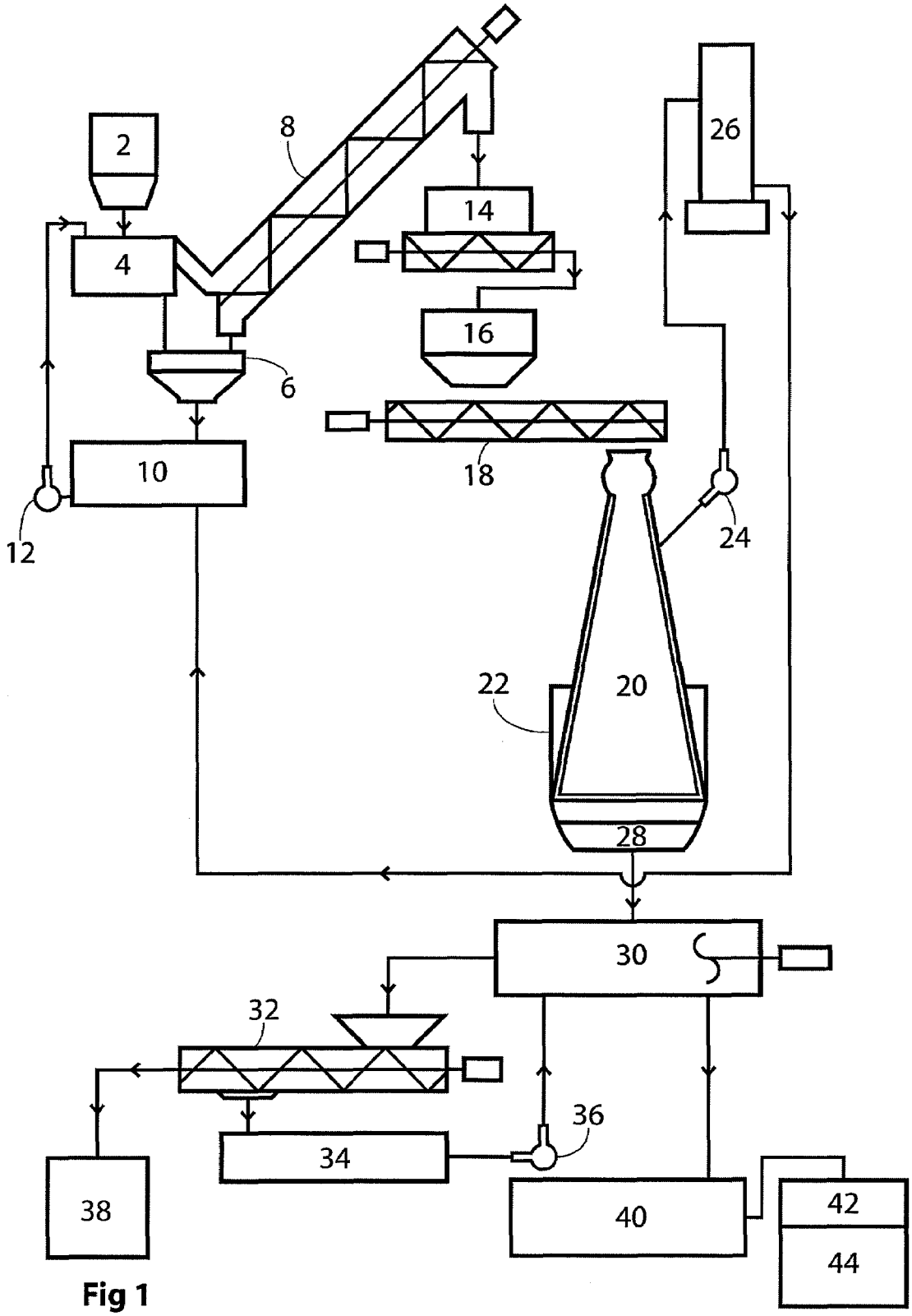
FIG. 1 is a schematic view of the parts used according to a preferred embodiment of the process.

FIG. 1 shows a schematic of the preferred embodiment of the process. Chips from infeed 2 are placed in impregnating chamber 4 along with an impregnate solution. After the chips have soaked for an appropriate amount of time, excess impregnate is removed and cleaned, such as by filter mechanism 6 and collected in recovery tank 10. It is then strengthened and returned, such as by pump 12, to impregnating chamber 4.

Meanwhile, the impregnated chips are moved by appropriate means, such as auger mechanism 8, to catalytic reactor 20. To control the feed of chips from impregnating chamber 4 to the catalytic reactor 20, various mechanisms may be used. In the preferred embodiment, holding tank 14 holds the impregnated chips until they may be fed through hopper 16 into measurement device 18. Measurement device 18 then controls the feed rate of chips into catalytic reactor 20.

In catalytic reactor 20, the chips are heated by heater 22 to a temperature above the evaporation temperature of the impregnate, but sufficiently low that the properties of the lignin compounds formed are not compromised. The chips are also agitated to ensure thorough heating of the biomass.

Evaporated impregnate is removed from catalytic reactor 20 by a mechanism such as pump 24 and collected in a condensing chamber or absorption tower 26. The impregnate is condensed and returned to recovery tank 10 for reuse in impregnating chamber 4.

Ouffeed 28 passes the catalyzed biomass into the digester 30, where the biomass is mixed with an alkaline solution. The mixture is heated and agitated in the presence of black iron to produce black liquor and pulp.

Excess black liquor is removed from the digested pulp by means such as press 32. Removed black liquor is collected in tank 34 and returned to digester 30, such as by pump 36. The pressed pulp is processed, such as by washer 38, as required.

Black liquor passes from digester 30 to lignin tank 40, where it is cooled, agitated and acidified to precipitate lignin, thereby forming sweet liquor and lignin.

The sweet liquor and lignin pass through a separation device, such as filter 42, where the lignin is collected for further processing. The sweet liquor passes through the filter 42 into fermentation tank 44.

In fermentation tank 44, bacteria is added to the sweet liquor to produce unicellular protein, which may then be processed as necessary.

Figure 3:
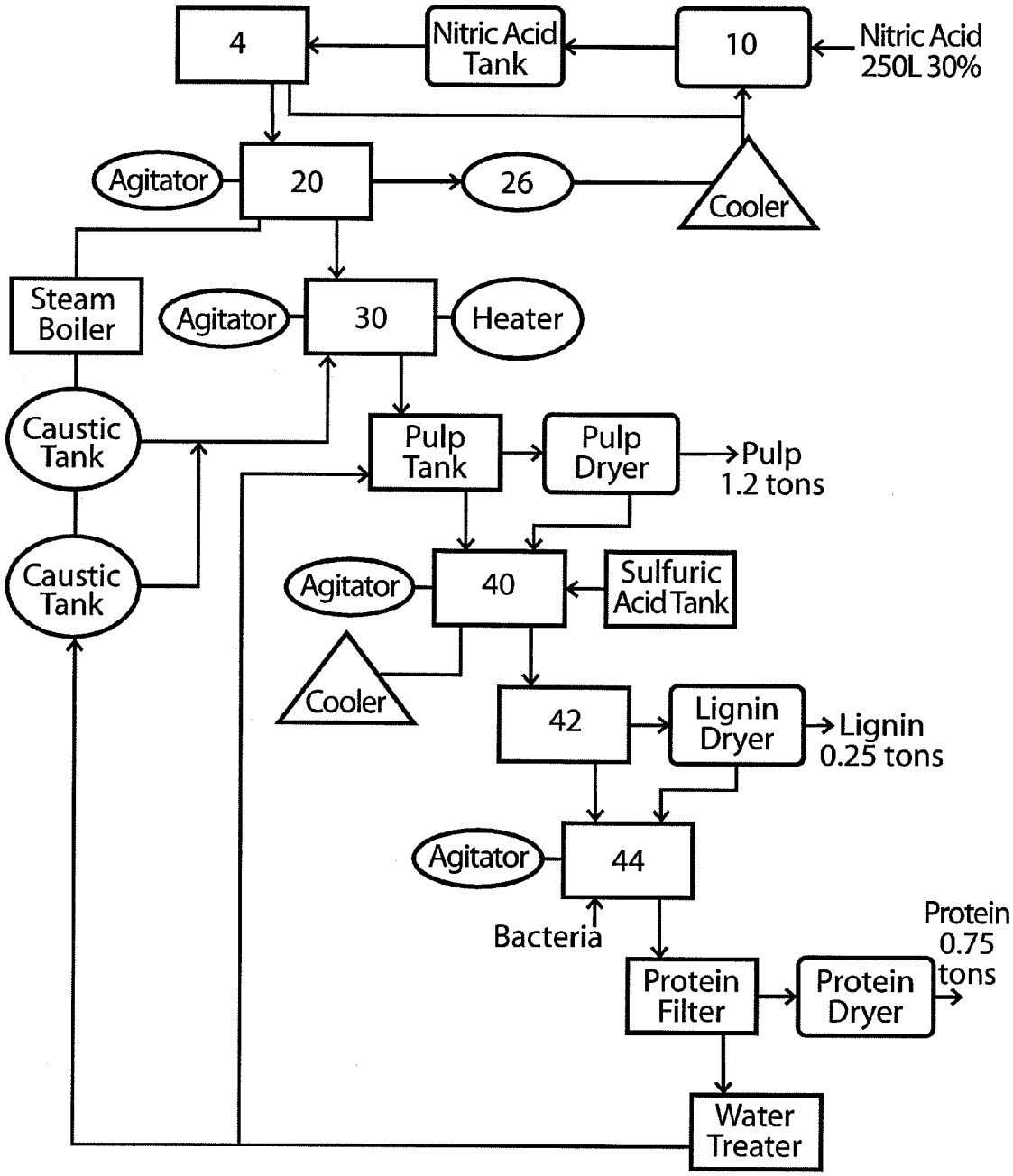
FIG. 3 is a flow chart and mass balance for pulp, lignin and protein during the Catalytic Reactor Process (Nitric Acid)
Figure 4:
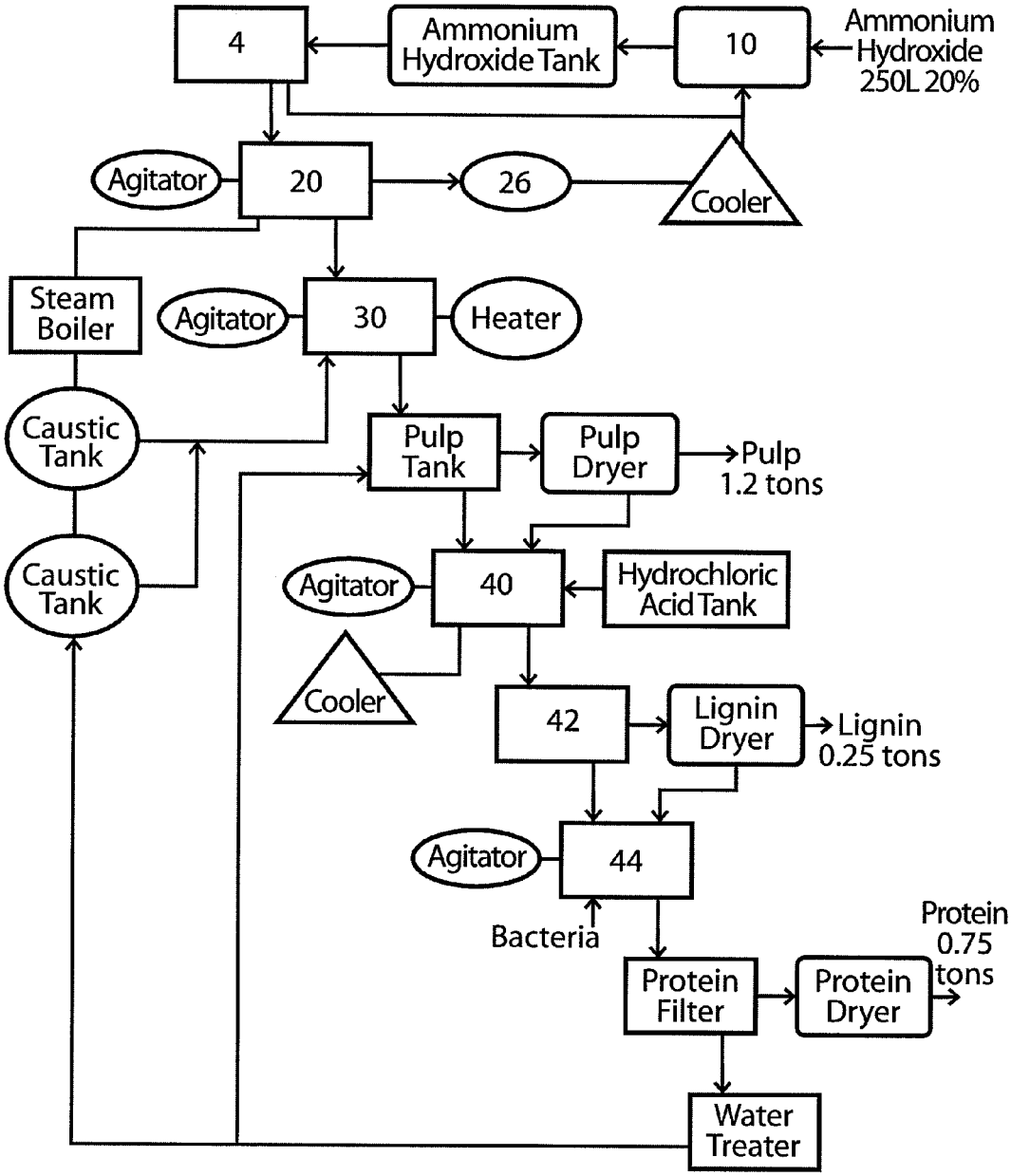
FIG. 4 is a flow chart and mass balance for pulp, lignin and protein during the Catalytic Reactor Process (Ammonium Hydroxide)

The following describes the process according to the preferred embodiment of the invention. The process is shown schematically in the flowcharts of FIGS. 3 and 4, for nitric acid impregnate and ammonium hydroxide impregnate, respectively.

Figure 2:
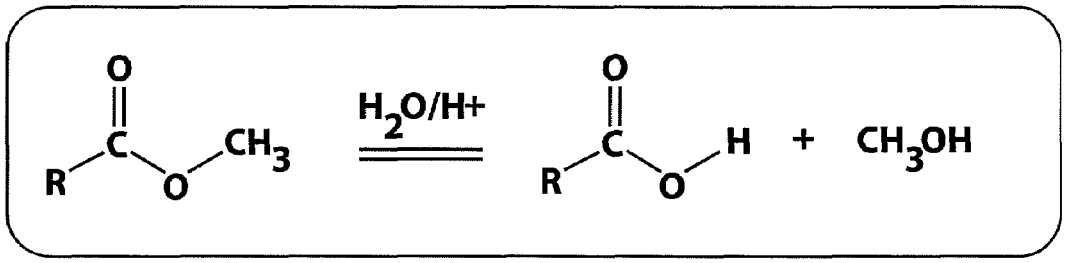
FIG. 2 is the acid catalyzed hydrolysis mechanism.
Figure 2:
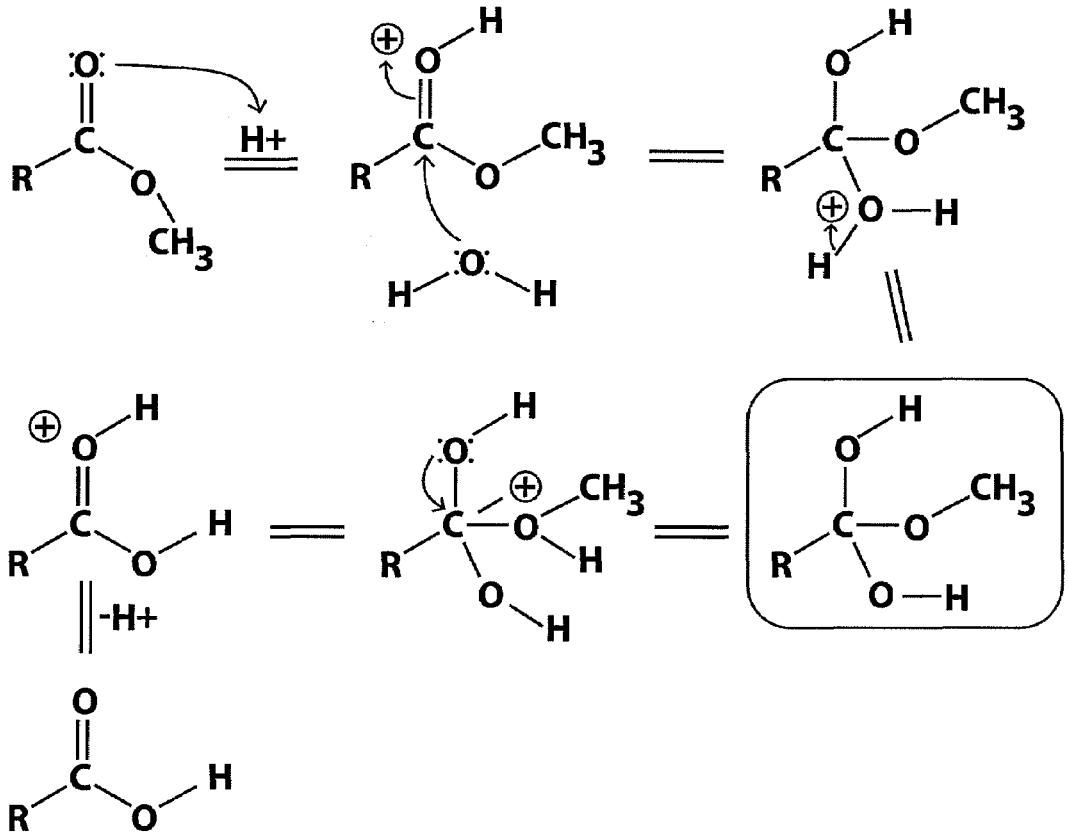

1. Raw material is prepared by chopping plant species into convenient lengths of hard and soft woods into chips approximately the size of existing commercially available chips in use today. However, smaller chips can be used due to the longer fiber lengths produced from the weaker chemicals and lower temperatures used in the CRP process.
2. The raw material is loaded into an impregnation chamber 4 and saturated with an impregnate. The impregnate may be nitric acid, ammonium hydroxide and/or both. For example, if the raw material is hardwood and nitric acid is used, the chips may be soaked in 15% $HNO_3$ for 18 hours. If the raw material is softwood or other vegetation, they are soaked in 12% $HNO_3$ for 16 hours. If the impregnate is ammonium hydroxide, the chips are soaked in 10% $NH_4OH$ regardless of the raw materials.
3. Excess impregnate is drained off, filtered and brought back to strength for reuse in recovery tank 10.
4. The impregnated material is transferred to the catalytic reactor 20 at a pH of 2 to 5. At this stage, temperature is maintained between 60° C. and 85° C. for a maximum of 80 minutes. It is important that the catalytic reactor 20 be kept within this optimal temperature and time range to produce high yields and quality of the finished products, especially unaltered lignin compounds. If the material is kept beyond the optimum time, then excessive material oxidization occurs rather than the preferred catalytic hydrolyzation of the lignin polymer, thus inhibiting the subsequent stages. Heating impregnated materials beyond the optimum temperature also leads to reduced yields and alters the desired state of lignin (rendering an inferior gummy product). The times held at optimum temperature range from 10 to 80 minutes depending on the raw materials used. The chemical reaction taking place during the catalytic reaction step is shown in FIG. 2.

During the heating of the impregnated material, impregnate is released in a vapor form, withdrawn and sent to a condensing chamber or absorption tower 26 where it is collected for reuse. After a sufficient time, the lignin is catalytically hydrolyzed to the desired molecular state and the raw material is now ready to be passed to the alkaline bath stage.

In this catalytic stage, agitation is important as in a large reactor there would not be sufficient time to thoroughly heat the entire mass of impregnated material before passing onto the alkaline digesting stage, thus affecting both yield and quality of final products.

5. Caustic soda is added to the material passed from the catalytic reactor 20 in the digester 30. The caustic soda strength is as follows:
   - 4 liters of 20% NaOH to 200 liters of water if the starting raw material is hardwood;
   - 4 liters of 15% NaOH to 200 liters of water if the starting raw material is softwood or other plant species.

The alkaline bath is heated to an optimum temperature range of 60-85° C. for a time period of 60 minutes. During this alkaline stage, at a pH of 9 to 12, the mixture is agitated in the presence of black iron and there is a separation of the pulp from the black liquor. The pulp passes through screeners and a press that extract any black liquor. The black liquor is recycled back into the alkaline digester. Once all the pulp has been removed from the alkaline bath, it is washed and dried and the remaining black liquor is returned to the digester 30, then is passed into the lignin tank 40.

Figure 6:
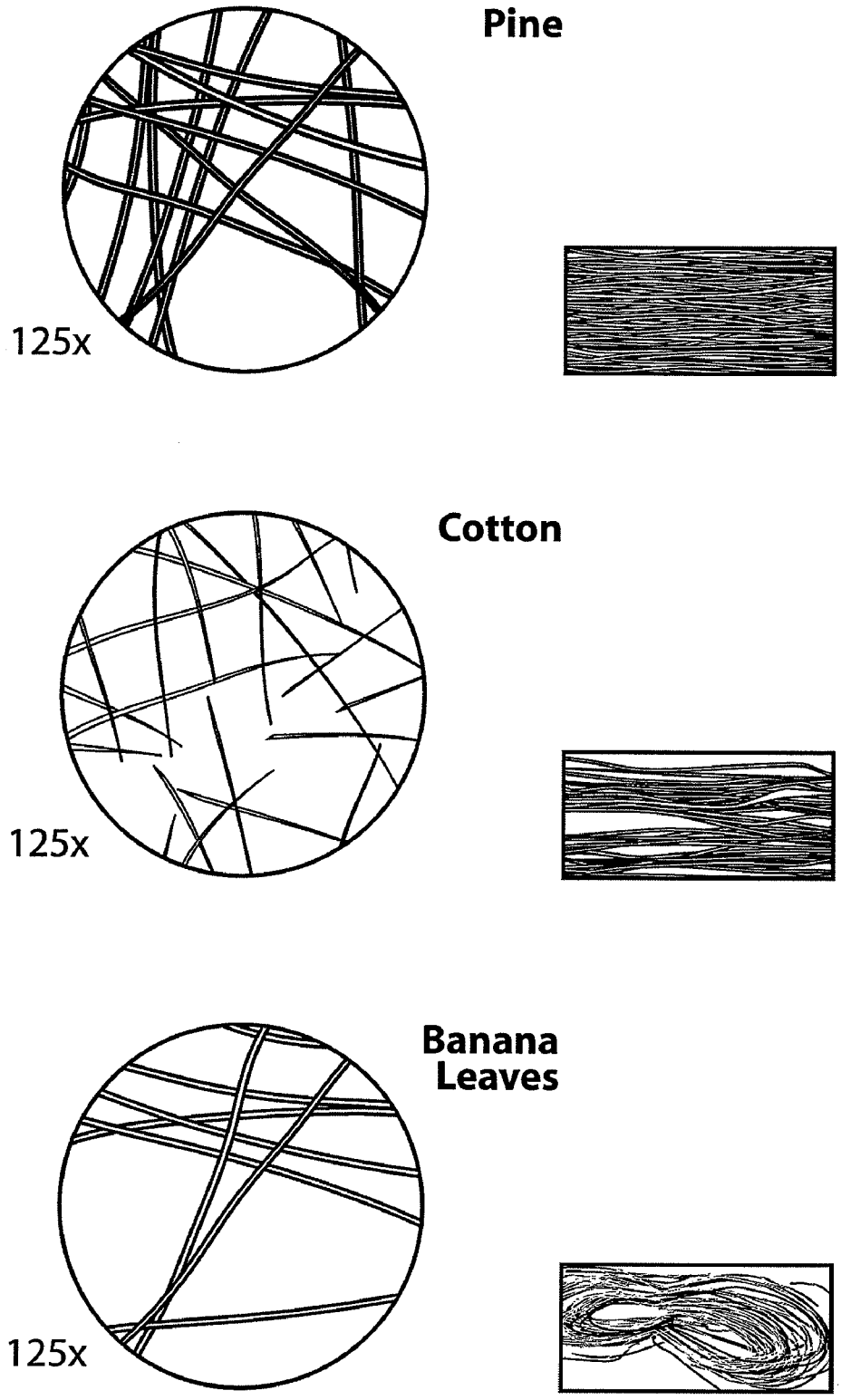
FIG. 6 is a series of photos of the fibers obtained through CRP from various fiber sources.

Photos of fibers obtained through the process, using various starting materials are shown in FIG. 6. Properties of the CRP pulp at this stage are shown in Table 1.

TABLE 1

Analysis results of the CRP pulp*

| Component | Sample 1 | Sample 2 |
|---|---|---|
| Alpha cellulose % | 86.5 | 85.7 |
| Beta cellulose % | 1.3 | 4.1 |
| Gamma cellulose % | 12.2 | 10.2 |
| Kappa number | 51.6 | 44.5 |
| Lignin content % (by calculation) | 7.74 | 6.68 |

*Sample was chlorited prior to testing with results calculated on chlorited sample weights. All results were calculated relative to sample weight on oven dry basis. Alpha, beta, and gamma cellulose: per ESM 035B (ref: TAPPI n03). Kappa number: per ESM 091B (ref: TAPPI T236).

6. The black liquor is passed into the lignin tank 40 and rapidly cooled to a temperature range of 43-50° C. (this is important to maintain the native state of the lignin). At this point, 10% sulfuric acid is added to the black liquor if the impregnate was nitric acid; 12% hydrochloric acid is added if the impregnate was ammonium hydroxide. The ratio of sulfuric acid to black liquor is 2 liters acid to 200 liters black liquor at a pH of 2 to 5. The agitators are started to precipitate the lignin from the black liquor before the mixture cools below 43° C. The separation process takes about 1 hour.

7. From the lignin tank 40, the sweet liquor and precipitated lignin mixture is released into a fermentation tank. The sweet liquor passes through a filter 42 while the lignin powder remains on top of the filter. The native lignin is carried to a dryer where it is dried at a temperature range of 43-50° C. Deviation from this range destroys the native lignin state. Properties of the native lignin are shown in Table 2.

TABLE 2

Analysis results of the CRP lignin

| Component | Sample 1 | Sample 2 |
|---|---|---|
| Klason Lignin % | 83.0 | 76.7 |

8. To the fermentation tank 44, a bacteria (torula) is added to the sweet liquor to activate the fermentation process. Once the fermentation is complete, the unicellular protein is filtered, dried and packaged, or washed to reduce pH and used for other products.
9. The residual water from the fermentation process is treated and recycled back into the process.

Agitators are used in the catalytic reactor 20 and digester 30 and are important to achieving the optimum results, as far as desired yields and quantity of finished product.

In the catalytic reactor 20, the agitators are used to achieve and maintain the optimum temperature range for the depolymerization of lignin to occur. The optimum temperature must be reached as quickly as possible to avoid undesired oxidization of the lignin. This oxidization will provide for lignin compounds to begin to form from the ketone, aldehyde, etc. chemical classes, all of which are undesirable. Also, oxidization of the lignin will provide cleaved sites to allow cross-linking between lignin polymers, another undesirable result. Oxidization will result in low yields of native lignin and sweet liquors depending on the extent of the oxidization reaction within the catalytic chamber. The design of the agitators is contingent upon whether a batch process plant, or a continuous feed plant is utilized. The agitators are used to both quickly bring up to temperature the impregnated biomass and begin breaking up the biomass itself.

In a continuous feed plant, agitators in the catalytic reactor 20 will also transfer continuously the impregnated biomass to the alkaline bath or digester 30.

In the digester 30, the agitators are used to achieve an optimal product yield. If reacted, the biomass is simply dropped into an alkaline solution and allowed to sit, and the surface of the chips will begin to undergo digestion. This will bring lignin out of the chips and into the alkaline solution. If lignin is left too long in the presence of NaOH, it will begin to oxidize, an unwanted result. Very aggressive agitation is utilized to tear the chips into ever-smaller pieces allowing the NaOH to quickly be utilized before the oxidization of the lignin begins in significant amounts. The result is sodium molecules attached to cleavage points on the lignin polymers rendering the lignin water-soluble.

The agitators also result in homogenous optimum temperature ranges.

The operating conditions of the process are as follows.

To treat 60 kilos of pine chips, the chips are impregnated with 315 liters of ammoniacal acid solution containing 27.5 liters of nitric acid and 4 liters of hydroxide of ammonia.

After 12 hours of impregnation, the acid solution is withdrawn for later re-circulation and the chips are placed in the reactor to effect the reaction of catalytic hydrolysis at temperature of 75° C., maximum 80° C. during the time of 90 minutes, taking into account, when it reaches the temperature of 75° C. during the reaction, the gases have recuperated the NOx in water or in recycled acid solutions.

At the end of the reaction, the chips are discharged in the alkaline bath for de-lignifying the chips, where they are preheated at 75° C. in a mixture of 315 liters of NaOH at 4%. The reaction of de-lignifying is done at about 80° C. and to a maximum of 90° C. for 90 minutes. The heating is then stopped to let it cool to 75° C., before the mixture is processed through a filter to separate the cellulose from the black liquor.

The black liquor is sent to a lignin tank where it is agitated and the concentrated sulphuric acid is carefully added until the pH is lowered to 3.0. It is left to rest and then passed through a filter to separate the lignin from the sweet liquor.

The filtered sweet liquor is sent to a fermentation tank where bacteria may be added to produce a unicellular protein.

At the end of the process, the lignin and cellulose is washed to retrieve the excess of acid and caustic soda respectively. The water that was used for the process is standard faucet or running water.

Figure 5:
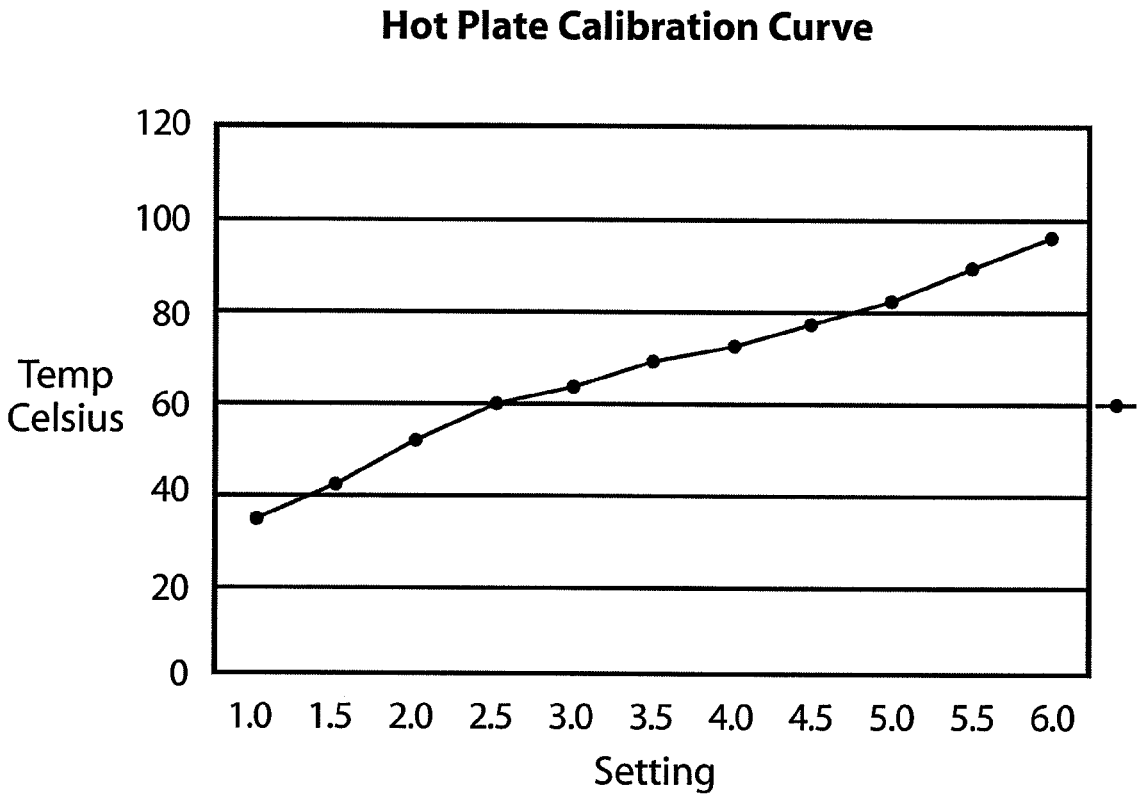
FIG. 5 is a hot plate calibration curve for CRP experiments.

The following are details of experiments run using the process of the invention. The pH values of the acids and bases used are listed in Table 3 and the calibration curve for the hot plate used is tabulated in Table 4 and graphically shown in FIG. 5.

TABLE 3 pH Values of Acids and Bases - May 17

| | Temp. ° C. | pH |
|---|---|---|
| Acids: | | |
| 12% nitric | 18.2 | 1.86 |
| 10% sulfuric | 18.3 | 1.85 |
| 12% hydrochloric | 18.3 | 1.90 |
| Bases: | | |
| 10% ammonium hydroxide | 18.2 | 12.42 |
| 15% sodium hydroxide | 18.2 | 13.23 |

TABLE 4

Hot Plate Calibration - May 17

| Setting | Temp. ° C. |
|---|---|
| 1.0 | 35 |
| 1.5 | 42 |
| 2.0 | 52 |
| 2.5 | 60 |
| 3.0 | 64 |
| 3.5 | 69 |
| 4.0 | 73 |
| 4.5 | 78 |
| 5.0 | 83 |
| 5.5 | 90 |
| 6.0 | 97 |

Nitric Acid Test:

May 19

To 500 ml Northern White Pine bedding (Sun Seed—Son thing Special)—weight 64.49 g—was added 500 ml of $H_2O$ and let soak for 15 minutes. Excess water drained. Wet mass now weighed at 503.75 g (Buchner funnel vacuumed for 15 min) with beaker. Beaker weight 390.21 g minus the weight of absorbed water is 113.54−64.49=49.05 g.

Poured in 700 ml of nitric acid at 11:10 a.m. May 19. Temperature of chips and acid was 15° C. (60F).

There was 440 ml of $H_2O$ (from soaking chips) left.

% $H_2O$=49.05/113.54=43.2%

Hot plate setting for 83° C. (182F) or 1.8-1.6 (turned switch off).

At 9:05—$HNO_3$ impregnate—added to Buchner funnel. Gravity drain for 30 minutes and soak time 21 hrs—55 minutes until May 20.

May 20

After impregnation, chips (wet) weighed 215.96 g 215.96−113.54=102.4/215.96×100%=47.42% nitric acid 102.42 g nitric acid 102.42 g nitric acid volume wise is approximately 800 ml.

At 10:00 a.m., started distillation (setting at 5) there was 605 ml of nitric acid drained off—pH was less than zero on the drained off acid.

After 10 minutes turned down to 1.6. Pure nitric acid was coming across. Vapor temp. 90° C.—nitric dropping into collection beaker with 100 ml $H_2O$.

| Minutes | Temp |
|---|---|
| 10 | 94-95° C. |
| 20 | 91° C. |
| 25 | 74° C. |

at 25 minutes, measure chip temp.=194F (88.9° C.)

Sample #1—50 ml of drained $HNO_3$ impregnate—pH less than zero

We recovered 110 ml $HNO_3/H_2O$ distilled volume—10 ml pure $HNO_3$ came across 10/110×100%=9.09%

| Minutes | Temp | |
|---|---|---|
| 30 | 68° C. | 83° C. (chips) |
| 60 | 70° C. | N/A |
| 70 | 70° C. | 86° C. (chips) |
| 80 | 70° C. | 92° C. (chips) |

Sample #2—first recovery at 25 minutes distillate—100 ml $H_2O$ and 10 ml $HNO_3$ Volume of 1st recovery 110 ml Put 10 ml 15% NaOH into 1 liter of $H_2O$ (mixture for alkaline bath)

11:40 a.m.—75° C. alkaline digester, chips put in stirring at 10 setting—added 2 black iron bolts.

Sample # 3—2nd recovery at 80 minutes distillate—100 ml $H_2O$ and 1.5 ml $HNO_3$ Volume of 2nd recovery—101.5 ml 12:10—added 12 black iron bolts.

12:25—added 90 ml of 15% NaOH temp. 87° C.—dropped hot plate setting to 4.

Temperature at 1:15 pm was 96° C. (too hot).

Strained out the pulp from black liquor. The black liquor volume was 920 ml. A 40 ml sample (sample #4 was collected).

Black liquor cooled in cold-water bath—Temp. was 44° C.

To the black liquor was added 10 ml of 10% $H_2SO_4$ to precipitate lignin and filtered—time was 1:45 pm.

0.86 g weight of filter paper

Another 10 ml of 10% $H_2SO_4$ was added and filtered.

Third acid addition was 80 ml of 10% $H_2SO_4$ at 3:15 pm—cover and set overnight Pulp wash water used—1600 ml Black liquor produced—1000 ml.

May 21

Dry pulp 22.08 g—light brown, coarse, short fiber

Filter paper #1-1.22 g—Wt. lignin—0.36 g (Tare 0.86 g) #2-0.99 g—Wt. lignin—0.13 g Vacuum filter 1000 ml of sweet liquor/lignin mixture after setting overnight (9:20 a.m.)

Sweet liquor volume 910 ml

Weight of liquor and filter paper 3.95 g

Weight of lignin=3.95−0.86=3.09 g (hard and black chunks)

Total lignins=3.09+0.36+0.13=3.58 g

Black liquor Specific gravity—0.999

Sweet liquor Specific gravity—1.003

Nitric Acid—May 20

To 100.04 g fresh chips was added—700 ml of 12% $HNO_3$— used approx. 300 ml too much.

4:00 p.m.—start of impregnation of Riverside pine chips—chips and slivers from bottom of conveyor to loading dock 18° C. (66F) impregnation temp. 10:15 a.m.—draining of $HNO_3$ yielded a volume of 660 ml—drained for 15 minutes. (sample # 6)—Bolts weight 183.79 g Put chips into distillation setup at 10:40 a.m. Chip temp. was 22° C. (72F)—Hot plate settings manual adjusted 1.0-1.6.

Nitric volume was (collected from distillation) 105.5 ml (sample #7) pH=0.70=5.5 ml of $HNO_3$.

At 1:00 p.m., added impregnated chips to 80° C. alkaline bath.

1:05 added another 10 ml of 15% NaOH

1:10 added another 10 ml of 15% NaOH

1:15 added another 10 ml of 15% NaOH

| | |
|---|---|
| At 1:00 | 80° C. |
| 1:10 | 74° C. |
| 1:20 | 76° C. |
| 1:30 | 85° C.-setting 4 |
| 1:40 | 85° C. |
| 1:50 | 86° C. |
| 2:00 | 85° C. |
| 2:10 | 85° C.-shut off agitator/heat |

830 ml of black liquor recovered, collected sample #8.

Added 30 ml $H_2SO_4$. Temp. at 2:30 p.m. was 36° C.

Filtered off pulp (100/0-15% sticks in long fiber pulp—yellow color.—1200 ml)

Water wash

May 22

Sweet liquor after filtering—740 ml—light straw yellow 40 ml Sample #9N

Pulp dried at 100° C.—wt 42.67 g

Lignin filter cloth 10:30 a.m. (dry overnight)—wt 1.60 g

Lignin filter paper #1 11:00 a.m. (air dry overnight)—wt 2.89–0.86=2.83 g

Lignin filter paper #2 11:15 a.m. (air dry overnight)—wt 2.82–0.86=1.96 g

Lignin filter paper #3 11:30 a.m. (air dry overnight)—wt 1.51–0.86=0.65 g light brown lignin—total wt 7.04 g Whatman filter paper #4—filter cloth nylon fine weave from pilot plant Black liquor Specific gravity—0.985

Sweet liquor Specific gravity—0.989

Tap water Specific gravity—0.982 at 20° C.

It will be appreciated by those skilled in the art that other variations to the preferred embodiments described herein may be practised without departing from the scope of the invention, such scope being properly defined by the following claims.

What is claimed is:

1. A method for producing pulp and lignin from lignocellulosic material, the pulp comprising cellulose, the method comprising:

contacting the lignocellulosic material with an aqueous acid solution to impregnate the lignocellulosic material, the aqueous acid solution comprising from about 10% to about 40% by weight of the acid and further comprising ammonium hydroxide;

heating the lignocellulosic material to a temperature that is at or above the boiling point of the aqueous acid solution to distill off the aqueous acid solution, without substantially degrading the cellulose or lignin in the lignocellulosic material;

contacting the lignocellulosic material with an aqueous alkaline solution under heat to solubilize lignin in the alkaline solution, leaving a black liquor;

removing the pulp from the black liquor;

adding sufficient acid to the black liquor to precipitate the lignin; and removing the lignin from the liquor.

2. A method for processing lignocellulosic material, comprising:

an impregnation step, wherein said lignocellulosic material is soaked in an impregnate solution comprising at least 10 weight percent of nitric acid and further comprising ammonium hydroxide;

a first recycling step, wherein said impregnate solution is drained, filtered, strengthened and recycled to said impregnation step;

a catalytic reaction step wherein said soaked lignocellulosic material is agitated in a catalytic reaction chamber and heated to a temperature above the vaporization point of said impregnate solution, thereby producing vaporized impregnate solution and a biomass;

a second recycling step wherein said vaporized impregnate solution is condensed and recycled to said saturation step;

a digestion step wherein said biomass is agitated in a digester in the presence of black iron and an alkaline solution to produce pulp and a full strength black liquor;

a processing step wherein said pulp is drained, washed and dried thereby producing dried pulp and dilute black liquor;

a third recycling step wherein said dilute black liquor is recycled to said digestion step;

a separation step wherein said full strength black liquor is cooled and agitated in the presence of an acid solution, thereby producing sweet liquor and precipitating natural form lignin;

a filtration step wherein said sweet liquor is filtered to remove said natural form lignin; and a fermentation step wherein said sweet liquor is added to bacteria in a fermentation tank, thereby producing a unicellular protein as a fermentation product.

3. The method of claim 2 wherein said impregnate solution comprises 10 to 30% acid by weight.

4. The method of claim 2 wherein said impregnate solution comprises 10-30% ammonium by weight.

5. The method of claim 3 wherein said impregnate solution comprises 10 to 30% ammonium by weight.

* * * * *